United States Patent [19]

Danna, Jr.

[11] 4,016,978

[45] Apr. 12, 1977

[54] CEMENT MIXER APPARATUS

[76] Inventor: Frank Danna, Jr., 1 Munson St., Croton-on-Hudson, N.Y. 10520

[22] Filed: Aug. 25, 1975

[21] Appl. No.: 601,875

[52] U.S. Cl. ..... 209/2; 209/245; 209/273; 209/352; 209/421; 259/169

[51] Int. Cl.[2] ..... B07B 1/00

[58] Field of Search ..... 209/245, 250, 281, 273, 209/352, 421, 409, 371, 260, 44, 2, 268, 270; 259/173, 145, 175–177, 169, 171, 172

[56] References Cited

UNITED STATES PATENTS

| | | | |
|---|---|---|---|
| 2,348,682 | 5/1944 | Jaeger et al. | 259/173 |
| 2,859,950 | 11/1958 | Graybill | 259/177 R |
| 2,942,731 | 6/1960 | Soldini | 209/270 X |
| 2,983,378 | 5/1961 | Hilkemeier | 209/2 |
| 3,278,022 | 10/1966 | Moeschler | 209/2 |
| 3,424,440 | 1/1969 | Upham et al. | 259/177 R X |
| 3,596,759 | 8/1971 | King et al. | 209/2 |

*Primary Examiner*—Frank W. Lutter
*Assistant Examiner*—Ralph J. Hill

[57] ABSTRACT

A device enabling the separation and removal of cementitious material from a concrete mix contained within a concrete mixer is provided. The concrete mixer, usually of the mobile type mounted on a land vehicle, comprises essentially, a drum or mixing vessel, a discharge or dump outlet and means for introducing water into the drum. The instant device comprises restraining and diverting member adapted to be positioned in alignment with said outlet, pulley means, for example pivotally mounting the device on the cement mixer enabling movement of the device from a position aligned with said outlet to a position displaced from said outlet, latch means for securing the device in aligned position with said outlet, and means for moving said device to a position out of alignment with said outlet, as required for normal operation of the concrete mixer.

6 Claims, 3 Drawing Figures

FIG. 1
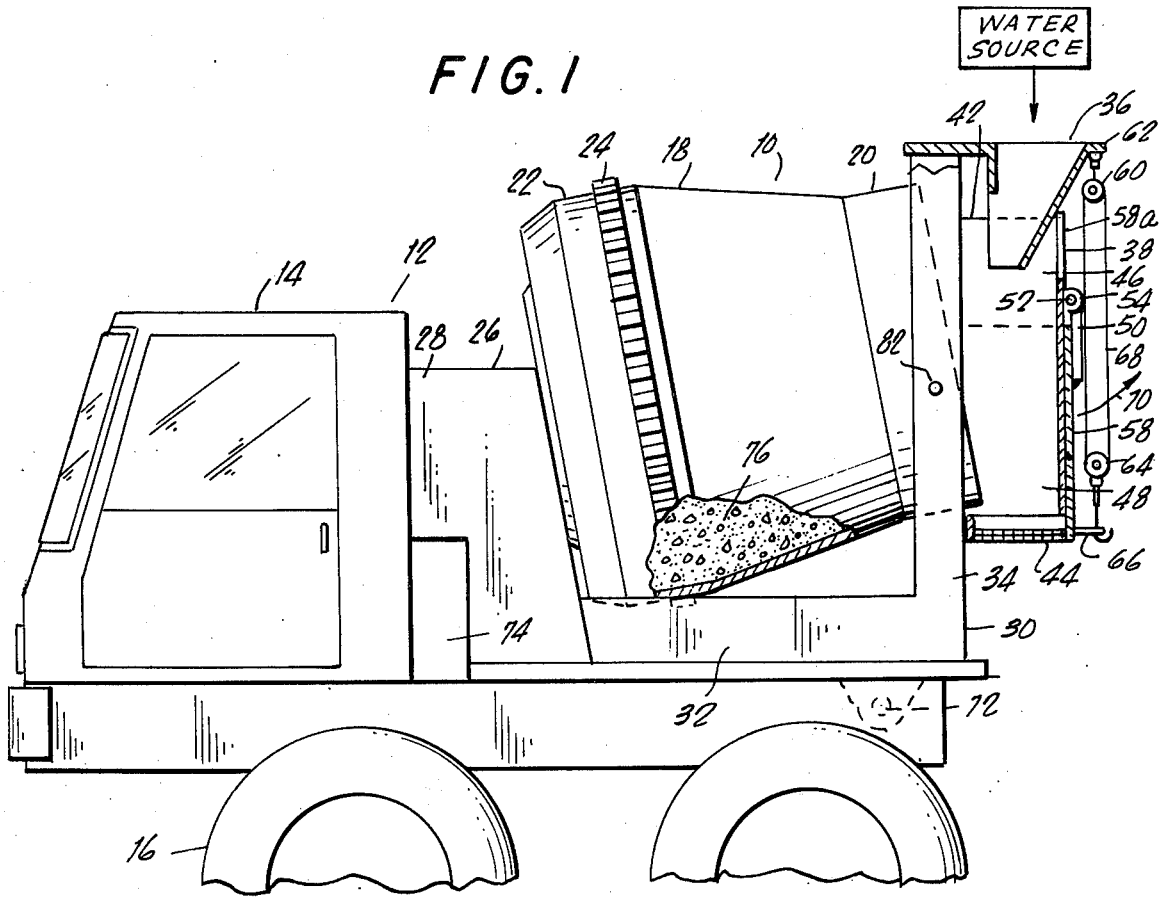
FIG. 2
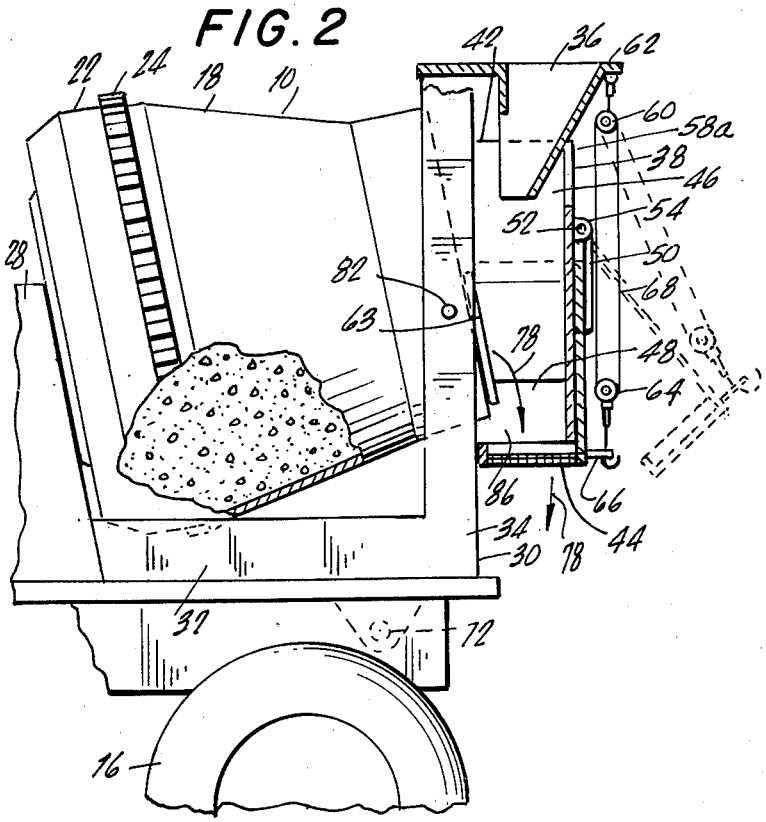
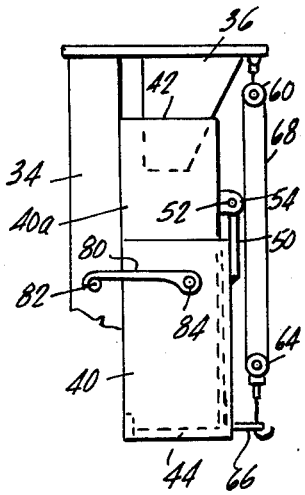
FIG. 3

CEMENT MIXER APPARATUS

BACKGROUND OF THE INVENTION

1. Field of the Invention

The present invention relates in general to concrete mixer apparatus and in particular to such apparatus provided with means enabling the separation, removal and reclamation of components of a cementitious mix.

2. Description of the Prior Art

Concrete mixer apparatus of diverse types are known in the art and in general comprise a mixing vessel for receiving the ingredients of a cementitious mix, a delivery or dump opening for discharging the concrete product formed from the cementitious ingredients, means facilitating the discharging of the concrete mix e.g., an auger, and means for enabling feeding dumping, mixing, etc., of the cementitious ingredients. In general, the concrete mixer apparatus is advantageously mounted on a land vehicle enabiing in-transit mixing of the cementitious ingredients for delivery to the work site.

Among the more serious disadvantages characterizing such apparatus are the loss of cementituous ingredients, particularly the sand, gravel and stone components, and the manifold difficulties associated with dumping to waste of unused concrete. Thus, it is common practice to charge the concrete mixer apparatus at the loading site with sufficient of the cementitious ingredients to produce an excess of product concrete at the work site thus providing a safety margin and assuring fulfilment of job requirements. However, the excess concrete portion is undesirable in that it must be dumped to waste. Thus, the cement mixer vehicle must be applied to non-productive purposes for a significant period of time not to mention the expense stemming from the maintenance of waste disposal sites, transportation to and from etc.

However, perhaps the primary disadvantages relates to the loss of the gravel and stone components of the waste concrete portion. Such ingredients are relatively costly and, as well be appreciated, continued waste dumpings invitably lead to significant economic loss.

Thus, a primary object of the present invention is to provide concrete mixer apparatus wherein the foregoing and related difficulties are eliminated or at least mitigated to a substantial extent.

Another object of the present invention is to provide concrete mixer apparatus capable of minimizing loss of cementitious ingredients through waste disposal.

Yet another object of the invention is to provide concrete mixer apparatus capable of more efficient utilization significantly decreasing time lost through non-productive use.

Still another object of the invention is to provide concrete mixer apparatus having a relatively simple arrangement of parts, which may be easily and economically manufactured.

Other objects and advantages will become more apparent hereinafter as the description proceeds.

The foregoing, and related objects are attained in accordance with the present invention which in its broader aspects provides cement mixer apparatus, and preferably of the mobile type having a device enabling the separation and reclamation of sand, gravel and related components from a concrete mix, the concrete mixer apparatus comprising a drum or mixing vessel, means for tilting the drum, a delivery outlet for discharging material from said mixing vessel, and means for introducing water into the drum, said device comprising restraint and diversion device means adapted to be positioned in alignment with said outlet, means pivotally mounting said device means on said concrete mixer, so as to be movable from a position aligned with said outlet to a position displaced from said outlet and means for securing said device in position in alignment with said outlet.

The invention is described by reference to the accompanying drawing wherein:

BRIEF DESCRIPTION OF THE DRAWINGS

FIG. 1 is a side elevational view shown partly broken away of a concrete mixer apparatus in accordance with the invention mounted on a land vehicle;

FIG. 2 is similar to FIG. 1 but illustrating the concrete mixer in discharge position; and FIG. 3 is a side elevational view illustrating a restraint and diversion device in accordance with the concepts of the invention in secured position.

DETAILED DESCRIPTION OF THE INVENTION

With continued reference to the accompanying drawing wherein like reference numerals designate similar parts throughout the several views, reference numeral 10 generally designates a concrete mixer mounted on a land vehicle 12 having a cab section 14 and wheels 16. Concrete mixer 10 comprises a drum or mixing vessel 18 which may taper into open ended neck portion 20. The drum portion 18 is provided at its forward end 22 with an external, toothed peripheral portion 24 which cooperates with power driven gear means (not shown) enabling rotation of concrete mixer 10 about its longitudinal, geometrically centered, axis as is known in the art. Rotation of concrete mixer 10 can be controlled, for example, by the operator of land vehicle 12, via suitable means, not shown, provided in cab section 14 and mechanically connected, as by axle means provided with gear means which engage and mesh with toothed peripheral portion 24. The carrier section 26 of land vehicle 12 comprises a supporting wall portion 28 to which the forward end 22 of drum 18 is securely attached and a supporting frame member 30 having horizontal support portion 32 and vertical support portion 34. It will be understood that the details of construction as regards the means employed for mounting the neck portion 20 of drum 18 within the supporting structure provided by horizontal support portion 32 and vertical support portion 34 are not critical herein, the essential consideration being structural stability. Neck portion 20 is in any event rotatable within its supporting housing. Thus, vertical support section 34 preferably comprises an essentially unitary member which closes about the periphery of neck portion 20 to provide the necessary support means for rotation of neck portion 20 therewithin. Attached to vertical support section 34 is a charging hopper 36 through which desired ingredients may be introduced into the concrete mix, and a screen housing generally designated 38 comprising an enclosure having sidewall portions 40 and **40*a* connected by rearward wall portions 58 and 58*a*, top portion 42 and a bottom screen member 44. By screen housing 38 is meant to include any type of restraining plate or the like including imperforate plates. As illustrated, charging hopper 36 extends into the upper portion 46 of screen housing 38. The bottom portion 48 of screen housing 38, which includes bottom screen member 44, is of generally L-shaped cross section and is attached to integral with an arm 50 rotatably mounted on an axle 52 housed within supporting frame 54 which is externally attached to or integral with rearward wall portion 58***a*. Rearward wall portion 58 and 58*a* as well as associated sidewall portion 40 and 40*a* respectively comprise separate member, their adjacent respective vertical edges abuttingly engaging each other at 52. If desired arm 50 may be spring biased urging rearward wall portion 58 to vertical position. Pulley 60, attached to the underside of an extending lip portion 62, provided on charging hopper 36 in combination with pulley 64 attached to an extending rim portion 66 provided on rearward wall portion 58, pulleys 60 and 64 being connected by continuous belt or line 68, provide means for rotating rearward wall portion 58 about point 56. In this manner, screen member 44 is displaced to the position illustrated by the phantom lines in FIG. 2, rotation of the bottom portion 48 of screen housing 38 proceeding as indicated by directional arrow 70 in FIG. 1.

Rotation of carrier section 26 as described is effected by means, not shown, conventional in the art for mobile cement mixing vehicles. Such rotation is usually controlled by means provided in the cab section 14 for actuating power driven axle-gear means. In normal position, wall portion 28 of carrier section 26 is supported by the top surface of supporting member 74 as illustrated in FIG. 1. The concrete mixing apparatus described herein can be operated as follows. The desired concrete-forming ingredient such as sand, gravel, pebbles, cement and the like are charged to drum 18 in the required proportions. Water, usually present in a separate tank, is introduced to the drum by means not shown from a water source as indicated by legend in the drawing and as is standard in the art. Drum 18 is rotated by means of toothed peripheral portion 24 engaging a power driven gear assembly as previously described. Rotation of drum 18 serves to impart the necessary turbulence for achieving intimate mixing of the cementitious ingredients. The foregoing is usually accomplished at the concrete supply site. Vehicle 12 is dispatched to the work site requiring the designated amount of concrete, mixing of the cementitious ingredients being continued in transit. The concrete formed from the cementitious ingredients as represented at 76 in FIG. 1, is discharged at the work site by operation of the auger for delivering the concrete mix rearwardly. In the dumping position illustrated in FIG. 2 the concrete ingredients 74 are urged in the direction indicated by arrows 78. Dumping of the concrete is effected by releasing latch 80 provided on sidewall 40 which engages a stud member 82 provides on vertical support section 34. As illustrated, latch 80 would be rotated clockwise about axle 84 thereby releasing bottom portion 48 of screen housing 38. By means of pulleys 60 and 64, bottom portion 48 is displaced to the position illustrated by the phantom lines in FIG. 2. Concrete mix 76 is thus discharged through delivery zone 86, displacement of screen 44 from alignment therewith enabling pouring of the concrete mix. If desired, a chute or equivalent means may be aligned with delivery zone 86 to facilitate collection of concrete. As previously indicated, there invariably remains an excess residue of concrete in drum 18 which may be significant. The cementitious components of this excess portion may be recovered in accordance with the present invention in the following manner. When dumping of the concrete is completed, sufficient water introduced into drum 18 to provide the concrete ingredient as an aqueous suspension of relatively fine particle size. Generally, the volume ratio of water to concrete should be about 1:1. Apart from the effective volume of drum 18, the maximum amount of water is not critical. The auger is driven first in the mixing direction. It is only required that the amount of water be sufficient to suspend the cement material therein. The remaining ingredients, i.e., gravel, stones, pebbles and the like remain as a sediment due to their particle size, specific gravity etc. With latch 80 secured in place as illustrated in FIG. 3, the aqueous suspension can be decanted off from the gravel residue by rotating the auger in the opposite and feed direction to feed the water and suspended cement material out of the outlet. As shown in FIG. 3, if desired, a baffle plate 63 may be suitably mounted for further holding back aggregate even when the mix is being fed from the carrier section 26. The aqueous suspension is discharged into delivery zone 86 and through screen member 44. To facilitate dumping of the aqueous suspension, the auger means provided with drum 18 may be operated. It may also be feasible to avoid tilting of carrier section 26 and rely solely on the auger means to accomplish discharge of the aqueous concrete suspension. In any event, the size or mesh of screen number 44 is such as to allow passage of the cement particles of the aqueous suspension yet prevent passage of the gravel and stone materials. Generally, the average size of the screen openings will be from about ⅛ to 2½ inches.

As will be evident from the foregoing the present invention by virtue of screen housing 38, enables separation of concrete and reclamation of gravel, stones and the like from a concrete mix utilizing the cement mixer itself to effect these operation. The residue now remaining in drum 18 is available for further concrete mixing operations. Moreover, land vehicle 12 is directly available for useful purposes, there being no necessity for waste disposal operations.

It will be understood that the foregoing description is given for purposes of illustration only and is not intended to be limitative. Thus, screen housing 38 may be provided as a separate unit for attachment to vertical support portion 34 with suitable fastener means being provided on the respective members. It is also advisable to provide screening member 44 as a removable member by detachably mounting same to rear wall 58 of screen housing 38. In this manner, screen 44 may be selected as required to accommodate ingredients over a wide range of particle size. In this embodiment, vertical support portion 34 may be provided on its rear surface with suitable fastener means for detachably engaging cooperative fastener means provided on the abutting edge of screen 44.

It will be further understood that means other than the illustrated pulley means may be employed to facilitate displacement of screen 44 from a position aligned with delivery zone or opening 86 to a position not aligned therewith.

A latitude of modification, substitution and change is intended in the foregoing disclosure, and in some instances, some features of the present invention may be employed without a corresponding use of other features.

What is claimed is:

1. A device enabling the separation and reclamation of gravel, stones, pebbles or the like from a concrete mix in combination with a mobile cement mixer having a drum, a delivery outlet, means for mixing and for feeding mix to said delivery outlet for discharging the contents of said drum, and means for introducing water into said drum; said device comprising screen means adapted to be positioned in alignment with said outlet, means mounting said screen means on said cement mixer, means for moving said screen means from a position aligned with said outlet to a position displaced from said outlet, and means for securing said screen in aligned position with said outlet.

2. A device according to claim 1 wherein said means for moving said screen means to aligned and displaced positions with respect to said delivery outlet comprises pulley means.

3. A device according to claim 1 wherein said screen means comprises the bottom portion of a screen housing enclosure attached to said cement mixer.

4. A device according to claim 3 wherein said screen housing comprises an upper portion and a lower portion, said lower portion being rotatable about axle means attached to said upper portion.

5. A device according to claim 4 wherein said axle means includes an arm member pivotally mounted thereon, said arm member being attached to said lower portion of said screen housing.

6. A device according to claim 1 wherein said screen means comprises a screen having openings of average diameter of from about ⅛ to 2½ inches.

* * * * *